US008333383B2

(12) United States Patent
Patelidas

(10) Patent No.: US 8,333,383 B2
(45) Date of Patent: Dec. 18, 2012

(54) POKER-TYPE CARD GAME

(75) Inventor: Antonio Patelidas, Las Vegas, NV (US)

(73) Assignee: G2 Game Design, LLC, Las Vegas, NV (US)

( * ) Notice: Subject to any disclaimer, the term of this patent is extended or adjusted under 35 U.S.C. 154(b) by 150 days.

(21) Appl. No.: 12/901,943

(22) Filed: Oct. 11, 2010

(65) Prior Publication Data

US 2011/0095481 A1 Apr. 28, 2011

Related U.S. Application Data

(60) Provisional application No. 61/254,582, filed on Oct. 23, 2009.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 6,817,615 B1 * 11/2004 Dacey ..... 273/292

* cited by examiner

*Primary Examiner* — Michael Dennis
(74) *Attorney, Agent, or Firm* — Weiss & Moy, P.C.; Jeffrey D. Moy

(57) ABSTRACT

An improved poker card game that provides a player with as many as eleven unique cards from which the player can form a five-card poker hand is provided. Game play can begin by dealing two cards to at least one player. A first community card is provided face-up. A first group of four community cards are dealt face-up and positioned diagonally from two of the corners of the first community card. A second group of four community cards are dealt face-up and positioned diagonally from the remaining two corners of the first community card. A best five-card poker hand is determined for each player. The best five-card poker hand can include between zero and two cards from the two cards dealt to each player and at least three cards from the first community card and the first group of four community cards and the second group of four community cards.

15 Claims, 3 Drawing Sheets

POKER-TYPE CARD GAME

REFERENCE TO RELATED APPLICATIONS

This application claims priority to U.S. Provisional Application No. 61/254,582 titled POKER-TYPE CARD GAME that was filed on Oct. 23, 2009 by Tony Patelidas and is hereby incorporated in its entirety, including any appendices, screen shots, and references therein.

TECHNICAL FIELD

This application relates generally to card games and methods thereof and, more particularly, to a poker-type game that provides players with the ability to form a poker hand from multiple community hands.

BACKGROUND

The card game of poker, with its many variations, has become an extremely popular form of entertainment. Poker is now a common social pastime for both gamblers and non-gamblers. The general aim of poker is to either collect a five card hand that is better than the five card hand of one or more opponents, or to try to bet in such a way as to cause opponents to believe that their hand is inferior and subsequently "fold" (concede or turn in) their hand. Typically, the game of poker involves several players competing against one another for one cumulative "pot" or sum of money. In casinos, the dealer or "house" draws a percentage, otherwise known as "the rake", of each pot, thus generating revenue regardless of which player wins each hand.

Two of the most popular poker games are Texas Hold'em and Omaha. In Texas Hold'em, each player receives an initial hand of two cards. Typically, there is a betting round followed by the dealing of three community cards face-up, known as "the flop." After another betting round, a fourth community card, known as "the turn" is dealt face-up. After yet another round of betting, the final community card, known as "the river" is dealt face-up. After the river, there is a final round of betting, assuming two or more players remain in the game. In Texas Hold'em, a player can use any combination of the two initial cards dealt to each player and the five community cards to form the best five-card poker hand. In fact, in Texas Hold'em, it can be possible to use neither of the two cards dealt to the player, and form a best five-card hand solely from the five community cards.

In Omaha, each player receives four playing cards, rather than two as in Texas Hold'em. The community card distribution and betting structure remain the same. In Omaha, however, each player must use exactly two cards out of the four they initially receive in combination with exactly three of the five community cards to form their best five-card hand. Omaha therefore lacks the flexibility of Texas Hold'em when it comes to forming a best five-card poker hand. However, Omaha does provide for more numerous and therefore exciting opportunities to form a best five-card hand, as there are a total of nine playing cards to choose from, as opposed to the seven in Texas Hold'em. Much of Omaha's popularity comes from the increased frequency of high-quality poker hands that result from forming a five-card hand from nine cards instead of seven. In the game of Omaha, this attractive feature comes with the restriction that limits a player to the use of exactly two of the four cards dealt to the player.

Therefore, both Texas Hold'em and Omaha offer separate, but intriguing benefits to poker players, while each game also has certain limitations that can make it less intriguing to different types of poker players. Neither Texas Hold'em nor Omaha provides a poker game having an increased frequency of high-value poker hands with additional flexibility and control over the hand that is dealt to each player.

SUMMARY

This summary is provided to introduce a selection of concepts in a simplified form that are further described below in the DESCRIPTION OF THE APPLICATION. This summary is not intended to identify key features of the claimed subject matter, nor is it intended to be used as an aid in determining the scope of the claimed subject matter.

In accordance with one aspect of the present application, a method of playing a poker-type card game is provided. The game can include dealing two cards to at least one player and dealing a first community card face-up. In addition, the method can include dealing a first group of four community cards face-up and positioned diagonally from two corners of the first community card. The method can also include dealing a second group of four community cards face-up and positioned diagonally from a remaining two corners of the first community card. The method can include determining a best five-card poker hand for the at least one player, the best five-card poker hand comprising between zero and two cards from the two cards dealt to the at least one player and at least three cards from the first community card and the first group of four community cards and the second group of four community cards.

In accordance with another aspect of the present application, a method of playing a poker-type card game is provided. The method can include dealing player cards to at least one player and permitting the at least one player to make at least one wager. In addition, the method can include dealing a first community card face-up permitting at least one player to make at least one additional wager and dealing a first group of community cards face-up and positioned diagonally from two corners of the first community card. The method can also include permitting at least one player to make at least one additional wager and dealing a second group of community cards face-up and positioned diagonally from a remaining two corners of the first community card. The method can include permitting at least one player to make at least one additional wager and determining a best poker hand for each at least one player when more than one player remains in the poker-type card game, the best poker hand comprising the player cards dealt to the at least one player and cards from the first community card and the first group of community cards and the second group of community cards.

In accordance with yet another aspect of the present application, a poker-type card game is provided. The game can include a set of player cards distributed to each player. In addition, the game can include a plurality of community cards comprising a first community card face-up along with a first group of community cards face-up and positioned diagonally from two corners of the first community card and a second group of community cards face-up and positioned diagonally from a remaining two corners of the first community card. Each player can achieve a best five-card poker hand by using the set of player cards and from the first community card and the first group of community cards or the second group of four community cards or community cards on adjacent corners of the first community card.

BRIEF DESCRIPTION OF DRAWINGS

The novel features believed to be characteristic of the application are set forth in the appended claims. In the descriptions that follow, like parts are marked throughout the specification and drawings with the same numerals, respectively. The drawing figures are not necessarily drawn to scale and certain figures can be shown in exaggerated or generalized form in the interest of clarity and conciseness. The application itself, however, as well as a preferred mode of use, further objectives and advantages thereof, will be best understood by reference to the following detailed description of illustrative embodiments when read in conjunction with the accompanying drawings, wherein:

DESCRIPTION OF THE APPLICATION

Figure 1:
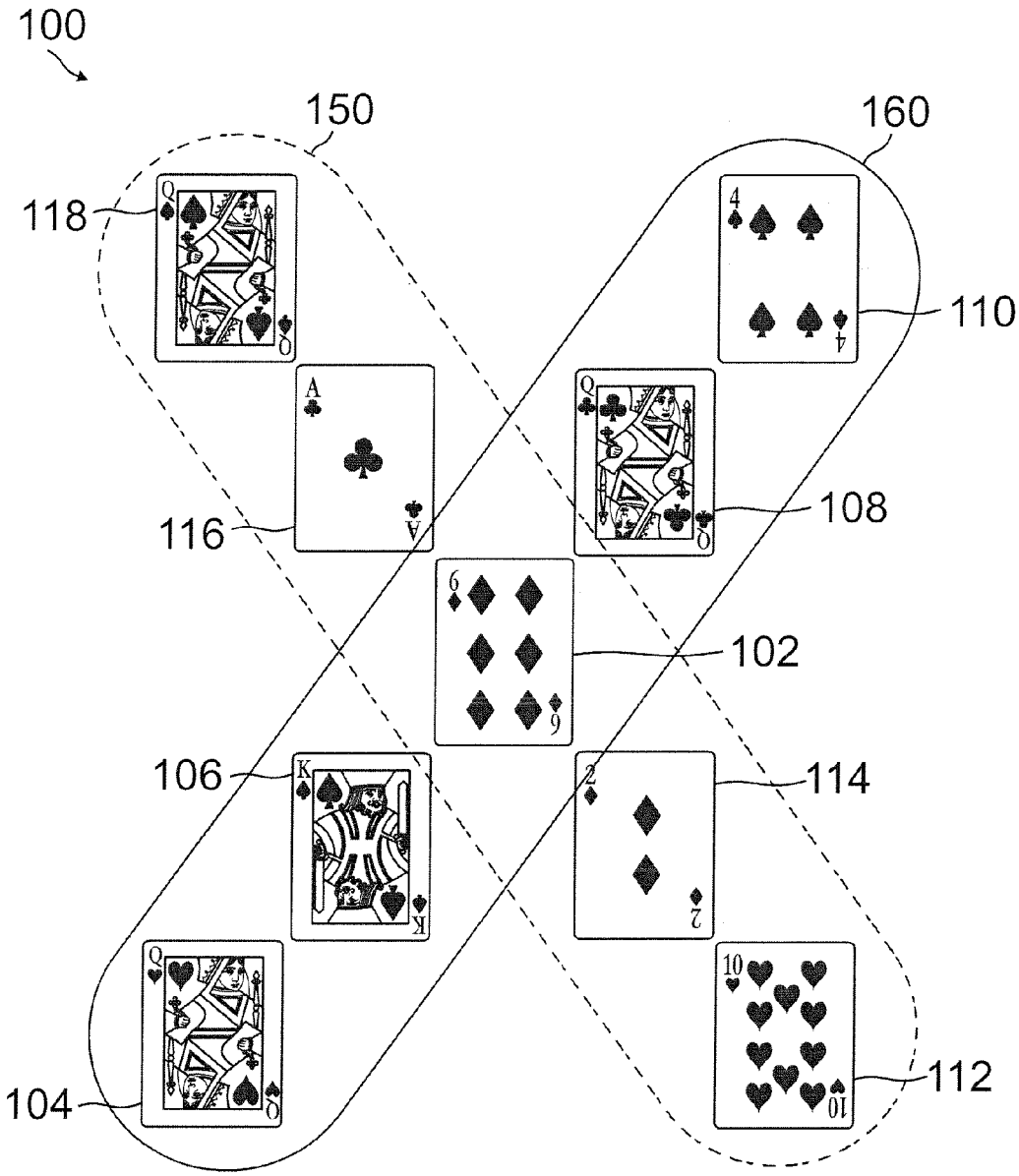
FIG. 1 is a top view of the preferred community card layout of the present application showing two of the six possible five card combinations that could be used as a community hand.

The description set forth below in connection with the appended drawings is intended as a description of presently preferred embodiments of the application and is not intended to represent the only forms in which the present application can be constructed and/or utilized. The description sets forth the functions and the sequence of steps for constructing and operating the application in connection with the illustrated embodiments. It is to be understood, however, that the same or equivalent functions and sequences can be accomplished by different embodiments that are also intended to be encompassed within the spirit and scope of this application.

Overview

The present application generally relates to an improved poker game, and more particularly, to a poker-type card game that provides players with the ability to form a poker hand from multiple community hands. In an illustrative embodiment, an improved poker card game that provides a player with as many as eleven unique cards from which the player can form a five card poker hand is provided. Game play can begin by dealing two cards to at least one player. A first community card is then provided face-up. A first group of four community cards are dealt face-up and positioned diagonally from two of the corners of the first community card. A second group of four community cards are dealt face-up and positioned diagonally from the remaining two corners of the first community card. A best five-card poker hand is then determined for each player when more than one player remains in the poker-type card game. The best five-card poker hand can include between zero and two cards from the two cards dealt to each player and at least three cards from the first community card and the first group of four community cards and the second group of four community cards.

As will be shown in the present application, an improved poker card game that provides a player with the option of using one of six separate five-card community hands along with zero to two individual cards to form a five card poker hand is provided. Variations to the provided illustrative embodiment are described herein. From those embodiments, numerous advantages will become apparent over Texas Hold'em, Omaha or other card game.

Game Play

The present application describes a method of playing a poker-type card game having many of the attributes of popular poker games such as Texas Hold'em and Omaha, but with other distinct advantages. Typical embodiments of the game can use a single fifty-two card standard deck. One or more decks can also be used. Other types of decks can be incorporated into the game as well. Known to those skilled in the relevant art, the game can be implemented on a number of different platforms such as a card table, computer, or other casino-type machine. If this game were played as a live table game with other players then preferably, as in Texas Hold'em and Omaha, a standard betting structure, such as the "big blind" and "small blind," can be used to establish the minimum bet by which any player must call to remain in the game. Alternatively, the game can be played as a "video" poker game in which there is only a single player against the machine, or the "house." In this embodiment, the player will simply try to achieve a hand having a poker value that corresponds to a pre-determined payout schedule.

Game play can begin with dealing at least two cards to each player playing the game. Referring now to FIG. 1 and in accordance with the method of playing the poker-type card game, a first community card 102 can be dealt face-up, which as shown is a six of diamonds. In live table play, the dealing of the community card 102 would be followed by the additional step of permitting at least one player to place at least one wager. As a video poker game, at least one and as many as nine community cards could be revealed to the player as shown in the layout 100.

In the preferred embodiment, after a first community card 102 is revealed four additional community cards 104, 106, 108 and 110 are dealt with two cards on each diagonal of the two corners of the first community card 102. The two corners can be the bottom left hand corner and the upper right hand corner. The number of community cards extending from the first community card 102 can be increased or decreased in each direction. The community cards 104, 106, 108 and 110 can be evenly distributed or in other embodiments can incorporate a non-uniform distribution, for example, three community cards 104, 106 and 108 on one corner and one community card 110 on the other.

In live play, at least one player is permitted to place at least one additional wager after the first group of community cards 104, 106, 108 and 110 are dealt. In one embodiment, poker rules can be followed that dictate matches or raises to stay within the game. Thereafter, the final four community cards 112, 114, 116 and 118 are dealt, or revealed in a video display, diagonally to the two remaining corners of the first community card 102 to create a substantially "X" shaped layout as shown in FIG. 1. Known to those skilled in the relevant art, variations in the order of dealing community cards 104, 106, 108, 110, 112, 114, 116 and 118 can be implemented. For example, community cards 112, 114, 116 and 118 can be dealt before cards 104, 106, 108 and 110. In one embodiment, cards 106, 108, 114 and 116 can be dealt first with cards 104, 110, 112 and 118 dealt next.

At least one player is preferably permitted to place a final round of wagering. After all nine community cards are dealt and/or revealed, each player can combine as few as zero and as many as the at least two cards initially dealt to each player with any one of the six possible five community card combinations that are formed by the substantially "X" shaped layout 100. In essence, these combinations are formed allowing a player to form a best hand.

The substantially "X" shaped layout 100 can produce six separate five card hands that each reach two ends of the "X" as shown in FIGS. 1-5. FIG. 1 is a top view of the preferred community card layout 100 of the present application showing two of the six possible five card combinations that could be used as a community hand. The combinations 150 and 160 use the diagonals created by opposite corners on the first community card 102. These cards located at non-adjacent corners incorporate those community cards from the first group or second group. The first combination 160 can include community cards 104, 106, 102, 108 and 110 and as shown, a queen of hearts, king of spades, six of diamonds, queen of clubs, and four of spades. A second combination 150 of community cards 112, 114, 102, 116 and 118 is also presented within FIG. 1. This combination 150, in the shown embodiment, can include a ten of hearts, two of diamonds, six of diamonds, ace of clubs, and a queen of spades. Common between both combinations 150 and 160 is the first community card 102.

Figure 2:
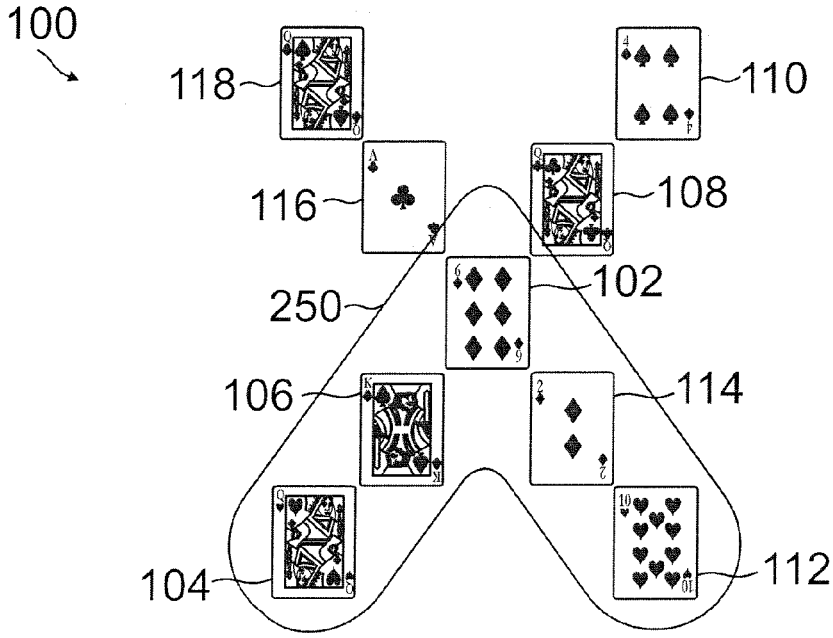
FIG. 2 is a top view of the preferred community card layout of the present application showing another of the six possible five card combinations that could be used as a community hand.

FIG. 2 is a top view of the preferred community card layout 100 of the present application showing another of the six possible five card combinations that could be used as a community hand. In this combination 250, community cards 104, 106, 114 and 112 that are located on adjacent corners of the first community card 102 are used. Cards 104 and 106 are from the first group while cards 112 and 114 are from the second group of community cards 100, thus allowing different community cards from different groups. This combination 250 can be referred to as the bottom combination 250 within the community card layout 100.

Figure 3:
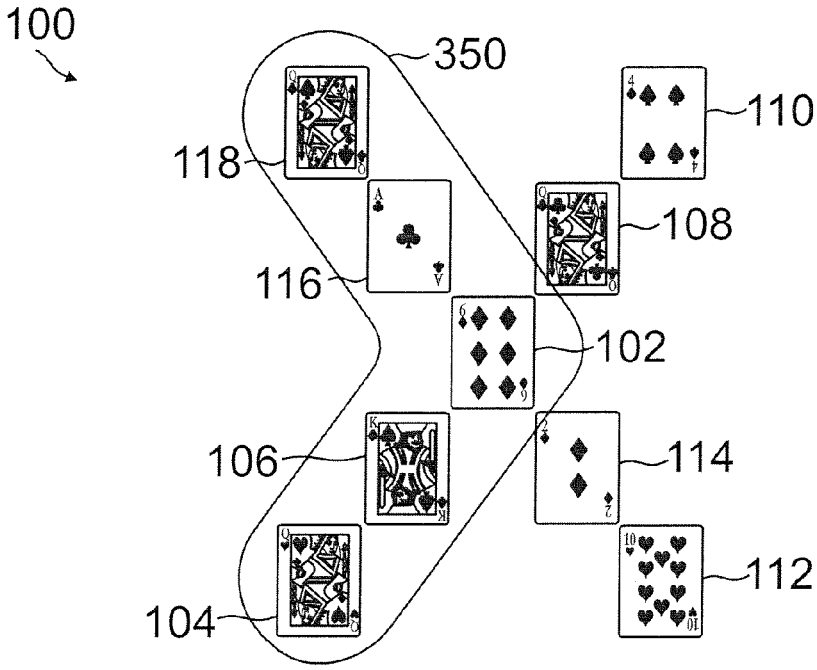
FIG. 3 is a top view of the preferred community card layout of the present application showing another of the six possible five card combinations that could be used as a community hand.
Figure 4:
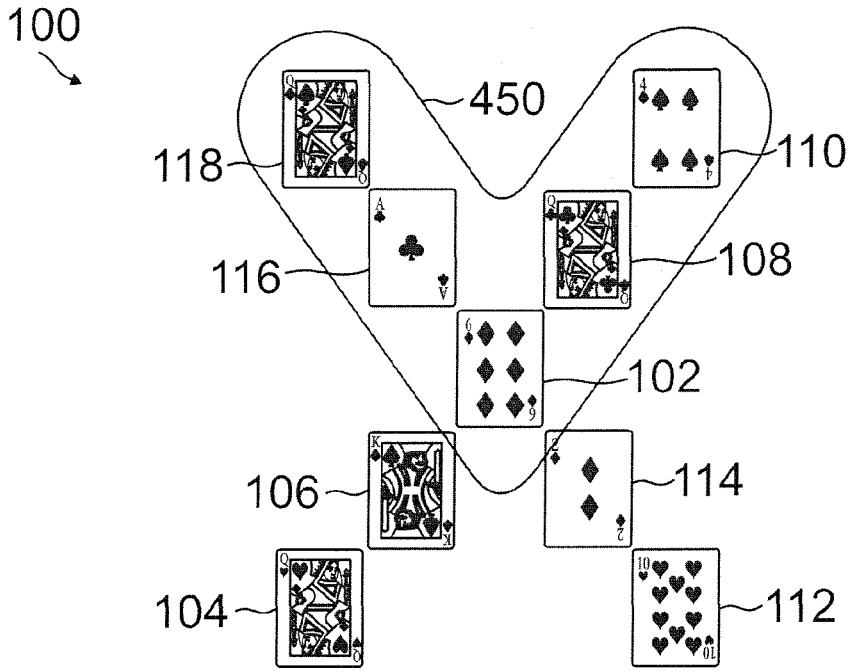
FIG. 4 is a top view of the preferred community card layout of the present application showing another of the six possible five card combinations that could be used as a community hand.

Turning to FIG. 3, a top view of the preferred community card layout 100 of the present application showing another of the six possible five card combinations that could be used as a community hand is provided. The combination 350 can include community cards 104, 106, 116 and 118 that are located on adjacent corners of the first community card 102. The combination 350 can be referred to as the left combination of the community card layout 100. FIG. 4 is a top view of the preferred community card layout 100 of the present application showing another of the six possible five card combinations that could be used as a community hand. Adjacent corners of the first community card 102 on the top portion of the layout 100 are grouped together in this combination 450.

Figure 5:
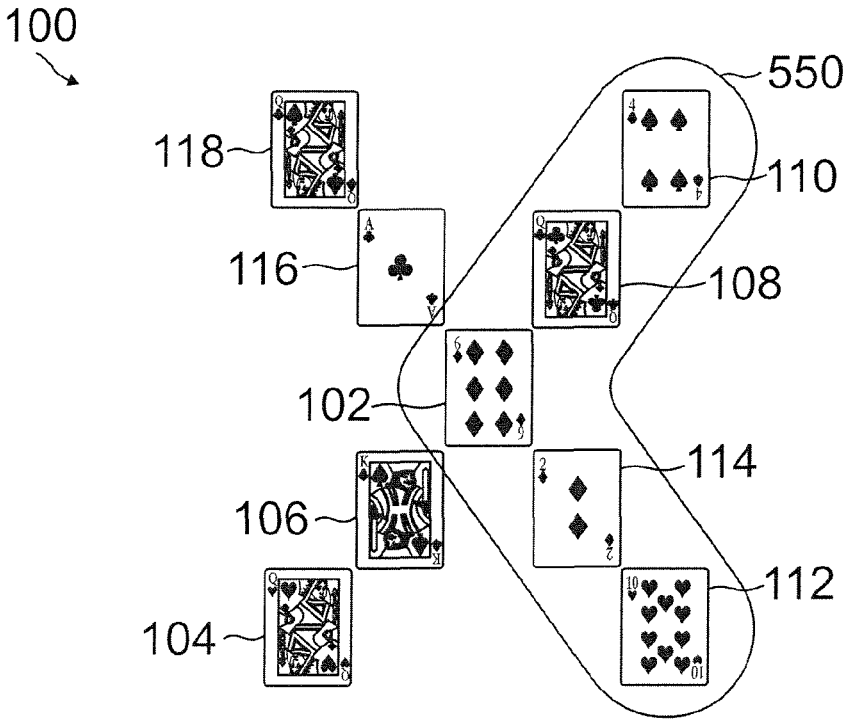
FIG. 5 is a top view of the preferred community card layout of the present application showing another of the six possible five card combinations that could be used as a community hand.

Representing the last combination 550, FIG. 5 is a top view of the preferred community card layout 100 of the present application showing another of the six possible five card combinations that could be used as a community hand. This combination 550 can be referred to as the right combination 550 of the layout 100. Those skilled in the relevant art will appreciate that other combinations can be taken as well. For example, the four interior community cards 106, 108, 114 and 116 can be used or the exterior community cards 104, 110, 112 and 118. More or less community cards within the layout 100 can be dealt extending the number of combinations that can be used.

A player could then either "play the board" by selecting one of these six five-card hands without using any cards dealt individually to the player. More frequently, however, a player can use one or more cards dealt individually to that player with four or fewer community cards 100 from one of the six separate five-card community hands. In a video format, the computer program can automatically select the combination that creates the five-card poker hand having the highest poker value. Alternatively, a dealer can make this identification during live play. Each player can achieve a best five-card poker hand using a set of player cards and the first community card and the first group of community cards or the second group of four community cards or community cards on adjacent corners of the first community card.

While numerous combinations were described above as being used to form a best five-card poker hand, one out of the six combinations can be used, or some variation thereof during game play. For example, the more credits a player plays in a casino-style gaming machine the more combinations the player can have to form their best hand. When two credits are played, the combinations 150 and 160 can be used to form a poker hand. When six credits are used, all the combinations 150, 160, 250, 350, 450 and 550 can be used. In live play, the combination can be predetermined such that the players would only look to a certain set of community cards. One advantage of removing the other combinations is that it would allow the player to easily determine whether they have a winning hand or not.

While, in the preferred embodiment, the poker-type card game of the present application is played at a casino with a betting structure that allows players to wager, it should be clearly understood that substantial benefit could be derived from an alternative embodiment of in which there is an alternative betting structure, or no wagering at all. For example, if this poker-type card game were to be played on a video gaming machine, over the Internet, or against a computer, it can be beneficial to have a different betting structure, no wager at all, or a single wager that would allow the player to qualify for a payout if his or her hand corresponded to a pre-determined poker value.

A best five-card poker hand using the two player cards with the six combinations of community cards in the layout 100 was previously presented. Known to those skilled in the relevant art, a best three-card or seven-card poker hand can be used within the game. Numerous types of other poker hands can be incorporated within the scope of this game.

Platforms

In one embodiment, a card table, known to those skilled in the art, can be used for this poker-type card game. The card table can include a wagering area, a player area, and a dealer area. Incorporated within the table can be a community card layout 100 area as shown in FIGS. 1-5. Typically, multiple players bet against the dealer. In another embodiment, the players can play against one other.

Casino style gaming machines can also be used to implement the game described above. These machines can allow a single player to play against a dealer, who can be computerized through known programming methods. Progressive jackpots can also be incorporated along with multi-gaming machines for playing against other players.

The game can be also played on a hand held device. The device can be used to challenge other players on an online system. For example, www.pokerstars.com already has an online system where players can play a myriad of poker games against each other. In other embodiments, the game on the hand held device can be a stand along game played against a dealer. In addition, other players can be computer based. In some formats, "fake" money would be used. Multiple other variations of the game can exist. For example, the game can come within a home version. The game can also be played at work from an internet browser.

Systems, Methods and Operations

In accordance with one aspect of the present application, a method of playing a poker-type card game is provided. The game can include dealing two cards to at least one player and dealing a first community card face-up. In addition, the method can include dealing a first group of four community cards face-up and positioned diagonally from two corners of the first community card. The method can also include dealing a second group of four community cards face-up and positioned diagonally from a remaining two corners of the first community card. The method can include determining a best five-card poker hand for the at least one player, the best five-card poker hand comprising between zero and two cards from the two cards dealt to the at least one player and at least three cards from the first community card and the first group of four community cards and the second group of four community cards.

In one embodiment, the method can further include receiving at least one wager from the at least one player before dealing the cards. In one embodiment, the method can further include receiving at least one wager from the at least one player after dealing the second group of four community cards. In one embodiment, dealing the first community card and the first group of four community cards and the second group of four community cards can form an X-type pattern.

In one embodiment, dealing the first group of four community cards can include distributing two community cards from the first group on one corner and distributing a remaining two community cards from the first group on an opposite corner. In one embodiment, dealing the second group of four community cards can include distributing two community cards from the second group on one corner and distributing a remaining two community cards from the second group on an opposite corner.

In one embodiment, the at least three cards can be taken from the first community card and the first group of four community cards or the second group of four community cards or community cards on adjacent corners of the first community card. In one embodiment, the at least three cards can be taken from the first community card and the first group of four community cards or the second group of four community cards. In one embodiment, determining a best five-card poker hand for the at least one player can occur when more than one player remains in the poker-type card game.

In accordance with another aspect of the present application, a method of playing a poker-type card game is provided. The method can include dealing player cards to at least one player and permitting the at least one player to make at least one wager. In addition, the method can include dealing a first community card face-up permitting at least one player to make at least one additional wager and dealing a first group of community cards face-up and positioned diagonally from two corners of the first community card. The method can also include permitting at least one player to make at least one additional wager and dealing a second group of community cards face-up and positioned diagonally from a remaining two corners of the first community card. The method can include permitting at least one player to make at least one additional wager and determining a best poker hand for each at least one player when more than one player remains in the poker-type card game, the best poker hand comprising the player cards dealt to the at least one player and cards from the first community card and the first group of community cards and the second group of community cards.

In one embodiment, permitting the at least one player to make at least one wager can include a big blind/small blind bet. In one embodiment, the first group of community cards and the second group of community cards can be initially provided face-down and turned when dealt. In one embodiment, the method can further include comparing a best poker hand for each of the at least one player and determining a winner of the game based on the comparison.

In one embodiment, the method can include one player and a computer-implemented player, the player competing against the computer-implemented player. In one embodiment, the method can include multiple players and a computer-implemented player, the players competing against the computer-implemented. In one embodiment, the method can include multiple players, the players competing against each other.

In one embodiment, the best poker hand can include any one of six possible five community card combinations that are formed by the first community card and the first group of community cards and the second group of community cards. In one embodiment, the best poker hand is automatically generated by a computer program.

In accordance with yet another aspect of the present application, a poker-type card game is provided. The game can include a set of player cards distributed to each player. In addition, the game can include a plurality of community cards comprising a first community card face-up along with a first group of community cards face-up and positioned diagonally from two corners of the first community card and a second group of community cards face-up and positioned diagonally from a remaining two corners of the first community card. Each player can achieve a best five-card poker hand by using the set of player cards and from the first community card and the first group of community cards or the second group of four community cards or community cards on adjacent corners of the first community card.

In one embodiment, the player cards and community cards are within a single 52 card deck.

The foregoing description is provided to enable any person skilled in the relevant art to practice the various embodiments described herein. Various modifications to these embodiments will be readily apparent to those skilled in the relevant art, and generic principles defined herein can be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

What is claimed is:

1. A method of playing a poker-type card game on a video poker machine comprising: causing a computer program to execute the following instructions: dealing two cards to at least one player; dealing a first community card face-up; dealing a first group of fore" community cards face-up and positioned diagonally from two corners of said first community card; dealing a second group of four community cards face-up and positioned diagonally from a remaining two corners of said first community card; and determining a best five-card poker hand for said at least one player, said best five-card poker hand comprising between zero and two cards from said two cards dealt to said at least one player and at least three cards from said first community card and said first group of four community cards and said second group of four community cards; wherein dealing said first community card and said first group of four community cards and said second group of four community cards forms an X-type pattern and wherein dealing said second group of four community cards comprises distributing two community cards from said second group on one corner and distributing a remaining two community cards from said second group on an opposite corner.

2. The method of claim 1, further comprising receiving at least one wager from said at least one player before dealing said cards.

3. The method of claim 2, further comprising receiving at least one wager from said at least one player after dealing said second group of four community cards.

4. The method of claim 1, wherein dealing said first group of four community cards comprises distributing two community cards from said first group on one corner and distributing a remaining two community cards from said first group on an opposite corner.

5. The method of claim 1, wherein said at least three cards are taken from said first community card and said first group of four community cards or said second group of four community cards or community cards on adjacent corners of said first community card.

6. The method of claim 1, wherein said at least three cards are taken from said first community card and said first group of four community cards or said second group of four community cards.

7. The method of claim 1, wherein determining a best five-card poker hand for said at least one player occurs when more than one player remains in said poker-type card game.

8. A method of playing a poker-type card game on a video poker machine comprising: causing a computer program to execute the following instructions: dealing player cards to at least one player; permitting said at least one player to make at least one wager; dealing a first community card face-up permitting at least one player to make at least one additional wager; dealing a first group of four community cards face-up and positioned diagonally from two corners of said first community card; permitting at least one player to make at least one additional wager; dealing a second group of four community cards face-up and positioned diagonally from a remaining two corners of said first community card, permitting at least one player to make at least one additional wager, and determining a best poker hand for each at least one player when more than one player remains in said poker-type card game, said best poker hand comprising said player cards dealt to said at least one player and cards from said first community card and said first group of community cards and said second group of community cards; wherein dealing said first community card and said first group of four community cards and said second group of four community cards forms an X-type pattern and wherein dealing said second group of four community cards comprises distributing two community cards from said second group on one corner and distributing a remaining two community cards from said second group on an opposite corner.

9. The method of claim 8, wherein permitting said at least one player to make at least one wager comprises a big blind/small blind bet.

10. The method of claim 8, wherein said first group of community cards and said second group of community cards are initially provided face-down and turned when dealt.

11. The method of claim 8, further comprising comparing a best poker hand for each of said at least one player and determining a winner of said game based on said comparison.

12. The method of claim 8, comprising one player and a computer-implemented player, said player competing against said computer-implemented player.

13. The method of claim 8, comprising multiple players and a computer implemented player, said players competing against said computer implemented player.

14. The method of claim 8, comprising multiple players, said players competing against each other.

15. The method of claim 8, wherein said best poker hand comprises any one of six possible five community card combinations that are formed by said first community card and said first group of community cards and said second group of community cards.

* * * * *